US006905168B2

(12) United States Patent
Noor

(10) Patent No.: US 6,905,168 B2
(45) **Date of Patent: *Jun. 14, 2005**

(54) STACKABLE FOLDING CHAIR

(75) Inventor: Zunaidi Bin Noor, Selangor (MY)

(73) Assignee: Mah Sing Plastics Industries Sdn Bhd, Selangor (MY)

( * ) Notice: Subject to any disclaimer, the term of this patent is extended or adjusted under 35 U.S.C. 154(b) by 0 days.

This patent is subject to a terminal disclaimer.

(21) Appl. No.: 10/421,702

(22) Filed: Apr. 24, 2003

(65) Prior Publication Data

US 2004/0004371 A1 Jan. 8, 2004

Related U.S. Application Data

(63) Continuation-in-part of application No. 10/102,664, filed on Mar. 22, 2002, now Pat. No. 6,592,182.

(51) Int. Cl.[7] ..... A47C 3/04; A47C 4/10
(52) U.S. Cl. ..... 297/239; 297/440.22; 297/58
(58) Field of Search ..... 297/239, 58, 440.22

(56) References Cited

U.S. PATENT DOCUMENTS

| | | | | |
|---|---|---|---|---|
| 1,674,220 A | | 6/1928 | Percival | |
| 1,876,549 A | * | 9/1932 | Bales | 297/41 |
| 2,390,878 A | | 12/1945 | Greitzer | |
| 3,021,175 A | | 2/1962 | Norquist | |
| 3,042,447 A | | 7/1962 | Wilkinson | |
| 3,431,022 A | | 3/1969 | Poppe et al. | |
| 3,655,239 A | * | 4/1972 | Agosti | 297/331 |
| 3,695,687 A | | 10/1972 | Uyeda | |
| 3,825,302 A | | 7/1974 | Kurtz | |
| 4,298,227 A | | 11/1981 | Berthier et al. | |
| 4,619,207 A | | 10/1986 | Boyce et al. | |
| 4,682,816 A | | 7/1987 | Massonnet | |
| 5,064,247 A | | 11/1991 | Clark et al. | |
| 5,096,259 A | | 3/1992 | Stanfield | |
| 5,167,436 A | | 12/1992 | Wu | |
| 5,634,684 A | | 6/1997 | Kojima et al. | |
| 5,718,474 A | * | 2/1998 | Kojima et al. | 297/58 |
| 5,738,408 A | | 4/1998 | Wu | |
| 5,967,605 A | | 10/1999 | Stanfield | |
| 6,099,073 A | | 8/2000 | Bruschi | |

FOREIGN PATENT DOCUMENTS

| | | |
|---|---|---|
| FR | 78 37000 | 7/1980 |
| FR | 2445125 | 8/1980 |
| GB | 20 98471 A | 11/1982 |
| IT | 536500 | 12/1955 |

* cited by examiner

*Primary Examiner*—Anthony D. Barfield
(74) *Attorney, Agent, or Firm*—Arent Fox PLLC

(57) ABSTRACT

An injection molded plastic stackable folding chair having a pair of parallel front legs and a pair of parallel back legs pivotally connected to the front legs. The front legs are separated by top and bottom crosspieces. A seat having a uniform and smooth lower surface is rotatably connected to the front legs by a rod and slidably connected to back legs by a pair of dowel pins engaging dowel slots formed within inner side faces of the back legs. The seat has a plurality of stacking guides and a stacking lip integrally formed therein. The stacking lip includes a notch that engages the top crosspiece of the back legs when the chair is in the open or in use position and receives a lower back corner of a second seat in the closed or folded position.

14 Claims, 15 Drawing Sheets

STACKABLE FOLDING CHAIR

CROSS-REFERENCE TO RELATED APPLICATION

This is a continuation-in-part of application Ser. No. 10/102,664, filed Mar. 22, 2002, and now U.S. Pat. No. 6,592,182.

BACKGROUND OF THE INVENTION

The invention relates to an improved folding chair. More particularly, the invention relates to a stackable folding chair having stacking guides and a notch that permit multiple chairs to be stacked on top of each other and maintained in an organized manner.

DESCRIPTION OF RELATED ART

It is well known that conventional folding chairs provide readily available seating. Typically, such chairs are used as temporary seating arrangements and are easily folded and stored when not in use. For situations involving large audiences, such as when used in arenas, for weddings, and other such events, the large number of folding chairs are usually stacked on top of each other and stored accordingly. Unfortunately, the conventional folding chair suffers from a drawback of being difficult to stack in an organized manner and tend to slide relative to each other when stacked. An attempt to overcome the sliding problem has been to configure containers or carts that are specifically structured to receive and hold the folded chairs in an orderly manner.

Attempts have also been made to design and manufacture folding chairs that do not require separate containers and/or carts specifically configured to store the folded chairs.

U.S. Pat. No. 5,634,684 to Kojima et al. discloses a typical example of stacked folding chairs wherein a separate brace device is attached to the chair legs so as to engage the brace of a second folded chair in order to stack multiple folded chairs. The Kojima et al. folding chair suffers from the drawback of requiring the brace as an additional component that is attached to chair, which increases the cost of manufacturing each chair and adds a step in stacking the chairs as a result of having to ensure the braces of the stacked chairs engage each other.

U.S. Pat. No. 5,738,408 to Wu discloses a stackable folding chair having protrusions integrally formed on a front side of the front legs and a corresponding number of indentations integrally formed on a back side of the same front legs opposite the protrusions. The indentations are configured to receive the protrusions from a second chair.

Therefore, when the chairs are folded and positioned adjacent to one another, the protrusions on the front side of the front legs of a first chair fit within the corresponding indentations on the back side of the front legs of the next or second chair. The first and second chairs are thus retained in the stacked arrangement. Furthermore, each protrusion has a first geometric shape occupying a first surface area. Each indentation is multi-leveled to have a first region adjacent an outer surface of the back leg having the same general geometric shape of the protrusion, but occupies a larger surface area. A second, inner region of each indentation is positioned inward of the first region and has the same geometric shape as the protrusion. The second region is dimensioned so the protrusion sits flush within the second region.

The indentations are formed to have multi levels so the person stacking the chairs can first locate the protrusion within the first region of the indentation. Because the first region of the indentation is larger than the protrusion, the person stacking the chairs is able to generally position the protrusion of the first chair within the first region of the corresponding indentation on the second chair. After the protrusions of the first chair are positioned within the first regions of the corresponding indentations of the second chair, the person stacking the chairs can position the protrusions within the second region to securely stack the first and second chairs together as the outer edges of the first region act as a boundary.

As such, the Wu folding chair suffers from complicated and costly manufacturing methods in order to machine the legs to have the multi leveled indentations capable of receiving the protrusions therein, thereby raising the cost of each chair. Furthermore, the step of aligning the protrusion first with the first region of the indentation and then the second region of the indentation can become rather cumbersome if a large number of chairs is involved in the stacking process.

Another example of an attempt to provide a stackable folding chair is disclosed in U.S. Pat. No. 6,099,073 to Bruschi. Bruschi discloses a stackable plastic folding chair having front legs with shaped portions that extend outwardly from opposite sides of an intermediate section to form stop abutments for ends of a back leg of an adjacent folding chair. The seat of the chair is connected to the front legs by pivot pins and is connected to the back legs by pivot pins. The pivot pins connecting the seat to the front legs are only rotatable, whereas the pivot pins connecting the seat to the back legs are slidable in grooves formed along a longitudinal axis of the back legs. The seat also has a transverse housing positioned at the rear of the seat.

The transverse housing has a U-shape when seen from a side view and is configured to hook a crosspiece connecting the back legs from below. It is important to note that the transverse housing is not a feature of the Bruschi chair involved in the stacking process.

Rather, each front and back leg has a right-angled profile including a larger wing and a smaller wing, respectively, with each large wing being perpendicular to its respective small wing. In the compacted position, the front and back legs are close to each other so as to substantially define side columns having C-shaped profiles. In the compacted position side columns, the large wings of the front legs are next to the small wings of the back legs. Accordingly, first and second shaped portions are provided at upper and lower end sections, respectively, of the front legs to form stop abutments for the first and second ends of the back legs of a second chair in the compacted position that is to be stacked with the first chair in the compacted position.

Put simply, Bruschi uses the wings formed by the shaped portions of the front and back legs to facilitate stacking of multiple chairs. The shaped portions require additional materials and manufacturing steps, thereby increasing the amount of time needed to produce each chair as well as the cost of such.

U.S. Pat. No. 5,967,605 to Stanfield discloses a folding chair having a stacking device or brace that is sized to be fitted snugly to a cylindrical chair leg. The brace engages the brace of a second chair wherein multiple chairs can be stacked in an orderly manner. The braces require additional materials as they are an additional component that must be added to the standard framework of the chair. The braces therefore require additional manufacturing time and material which result in an increased overall cost of the chair.

In the stackable folding chair disclosed in co-pending patent application Ser. No. 10/102,644, stacking guides 34, 34 and a stacking notch 41*a* are integrated into the structure of the seat 30 of the chair 1. As shown in FIGS. 1–6, the chair 1 also includes a pair of parallel front legs 11, 12 and a pair of parallel back legs 21, 22 pivotally connected to the front legs 11, 12. The front legs 11, 12 are separated by top, bottom and intermediate crosspieces 15, 13, and 14, respectively, wherein the top crosspiece 15 forms a back rest. The back legs 21, 22 are separated by a top and a bottom crosspiece 24 and 23, respectively. A seat 30 is rotatably connected to the front legs 11, 12 by a rod 31 between the backrest 15 and intermediate crosspiece 14 and slidably connected to the back legs 21, 22 by a pair of dowel pins 38, 38 that engage dowel slots 29, 29 formed on the inner side face of each back leg 21*a*, 22*a*.

The seat 30 includes a plurality of stacking guides 34, 34, a stacking lip 40*a* integrally formed therein, and a receiving groove 35 that receives the intermediate crosspiece 14 of the main frame 10 when the chair 1 is folded. The stacking guides 34 extend downward and away from a bottom surface 33 of the seat 30 and the stacking lip 40*a* extends in a direction relatively orthogonal to a top surface of the 39 seat 30 to form a substantially right angle shape. The extending direction of the stacking lip 40*a* is substantially opposite the extending direction of the stacking guides 34, 34.

The stacking lip 40*a* includes a notch 41*a* that engages the top crosspiece 24 of the back legs when the chair 1 is in the open or in use position and receives a lower back corner 42*b* of a second seat in the closed or folded position, wherein the first and second chairs are orderly stacked together.

The intermediate crosspiece 14 of the main frame 10 requires additional material, additional manufacturing time, and increases the overall cost of the chair 1. Furthermore, the receiving groove 35, which engages the intermediate crosspiece 14 of the main frame 10, requires a rather complicated die in which the plastic or resin is injected to form the bottom surface 33 of the seat 30. Additionally, the presence of the receiving groove 34 can decrease the overall strength of the seat 30.

SUMMARY OF THE INVENTION

It is an object of this invention to overcome the above-described drawbacks of the related art.

It is also an object of this invention to provide a stackable folding chair having longitudinally extended stacking guides and a stacking notch integrated into the structure of the seat of the chair, wherein the main frame of the chair includes only top and bottom crosspieces separating the legs thereof and the bottom surface of the seat omits the receiving groove, resulting in a seat bottom surface that is relatively smooth, except for the stacking guides extending along and therefrom.

It is yet another object of this invention to provide a stackable folding chair having a pair of parallel front legs and a pair of parallel back legs pivotally connected to the front legs. The front legs are separated by top and bottom crosspieces, wherein the top crosspiece forms a back rest. The back legs are separated by a top and a bottom crosspiece. A seat is rotatably connected to the front legs by a rod between the backrest and bottom crosspiece and slidably connected to the back legs by a pair of dowel pins that engage dowel slots formed on the inner side face of each back leg. The seat includes a plurality of longitudinally extended stacking guides and a stacking lip integrally formed therein. The stacking guides extend downward and away from a bottom surface of the seat and the stacking lip extends in a direction relatively orthogonal to a top surface of the seat to form a substantially right angle shape. The extending direction of the stacking lip is substantially opposite the extending direction of the stacking guides. A bottom surface of the seat is relatively uniform and smooth with the exception of the stacking guides extending along and therefrom. The stacking lip includes a notch that engages the top crosspiece of the back legs when the chair is in the open or in use position and receives a lower back corner of a second seat in the closed or folded position, wherein the first and second chairs are orderly stacked together.

These and other objects and aspects of the invention will be described in or be apparent from the following description of the preferred embodiment.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENT

Figure 7:
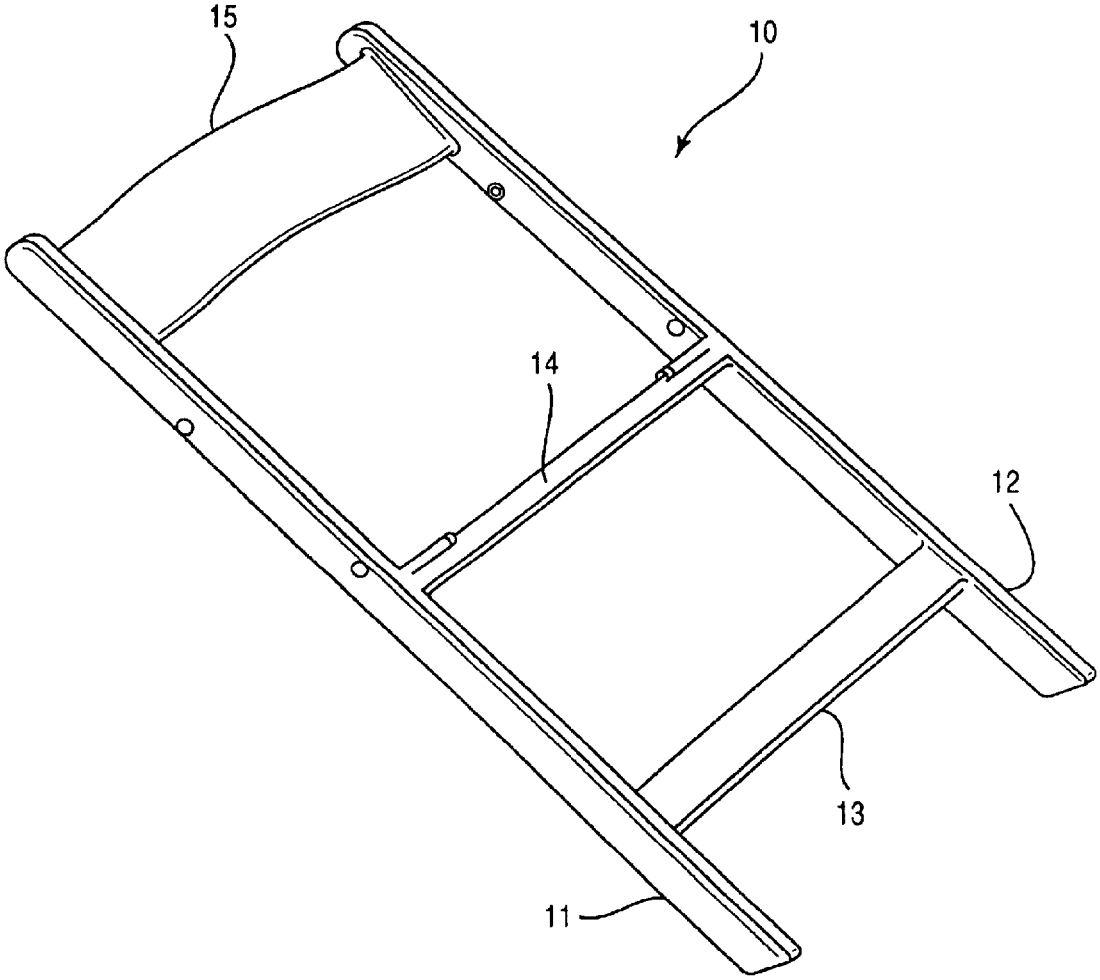
Fig.7 RELATED ART
FIG. 7 is a perspective view of the main frame of the conventional chair shown in FIG. 1.
Figure 8:
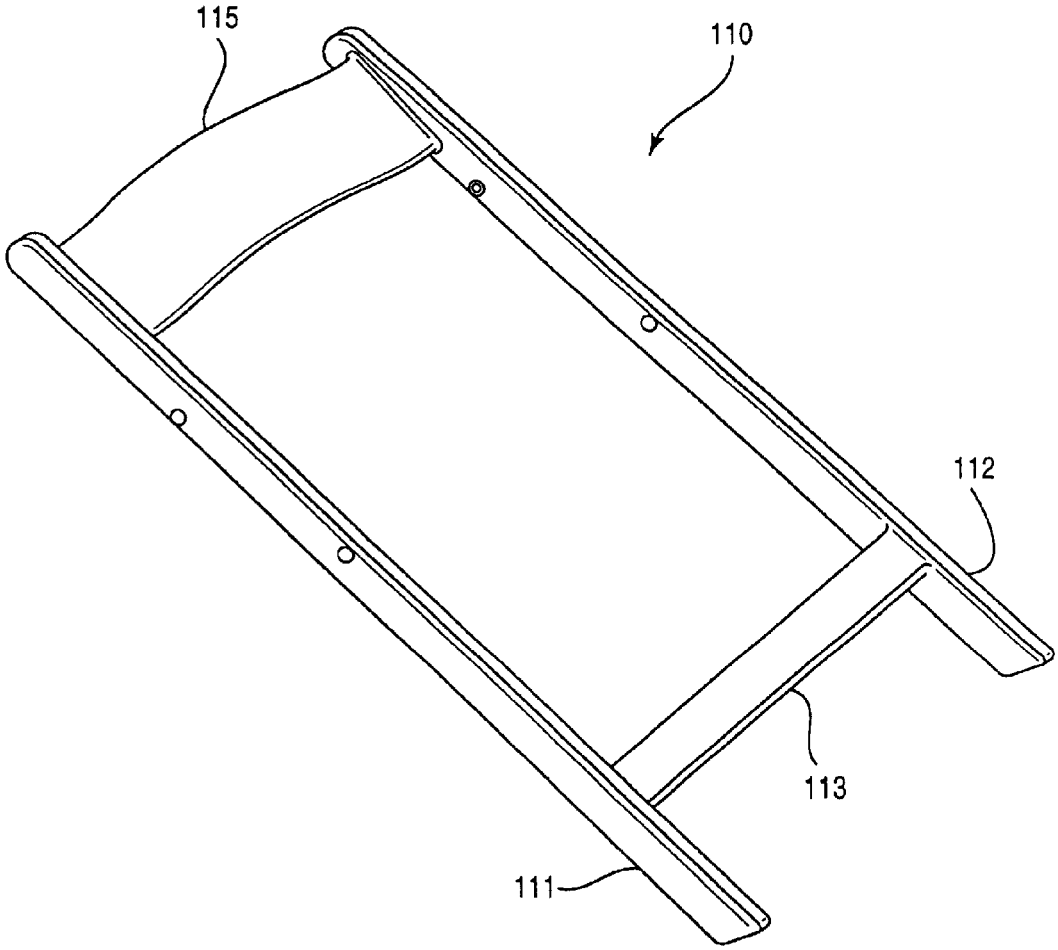
FIG. 8 is a perspective view of the main frame of the stackable folding chair according to the present invention.

FIG. 7 is a perspective view of the main frame 10 of the conventional stackable folding chair 1 shown in FIGS. 1–6. The main frame 10 includes a pair of substantially parallel front legs 11 and 12 separated by a bottom crosspiece 13, an intermediate crosspiece 14, and a top crosspiece 15, wherein the top crosspiece 15 forms a backrest. FIG. 8 is a perspective view of a main frame 110 of a stackable folding chair according to the present invention. As shown in FIG. 8, the main frame 110 includes a pair of substantially parallel front legs 111 and 112, separated by top and bottom crosspieces 115 and 113, wherein the top crosspiece 115 functions as a backrest. A comparison of the main frame 10 from the conventional chair and the main frame 110 from the stackable folding chair of the present invention reveals the fact that the main frame 110 of the present invention does not include an intermediate crosspiece and therefore requires less material to manufacture, which results in a simpler injection die, requires less time to manufacture, and lowers overall costs.

The main frame 110 of the present invention operates with the support frame 20 of the conventional stackable folding chair shown in FIGS. 1, 3, and 5–6. The support frame includes a pair of substantially parallel back legs 21 and 22 pivotally connected to the front legs 111 and 112 by pivot pins 27, 27. The back legs 21 and 22 are separated by a bottom crosspiece and a top crosspiece, 23 and 24, respectively.

It should be noted that it is preferable that the components of the stackable folding chair according to the present invention are primarily formed using plastic or resin injection molding techniques. However, it is within the scope of this invention to manufacture the components of the chair from any other suitable material, such, as, for example, metal, wood, and the like.

Figure 2:
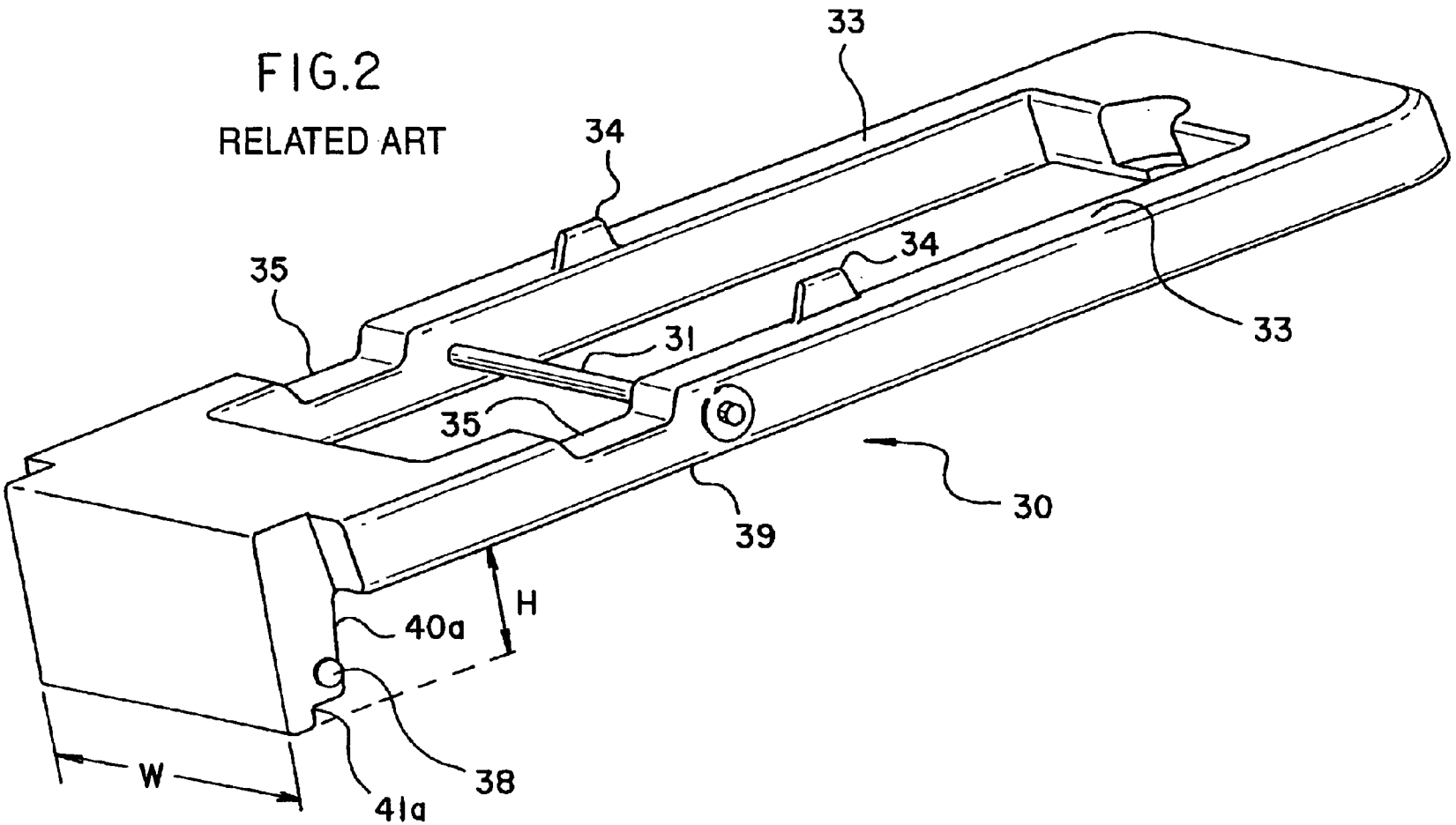
FIG.2 RELATED ART
FIG. 2 is a perspective view of the seat of the conventional stackable folding chair shown in FIG. 1.
Figure 3:
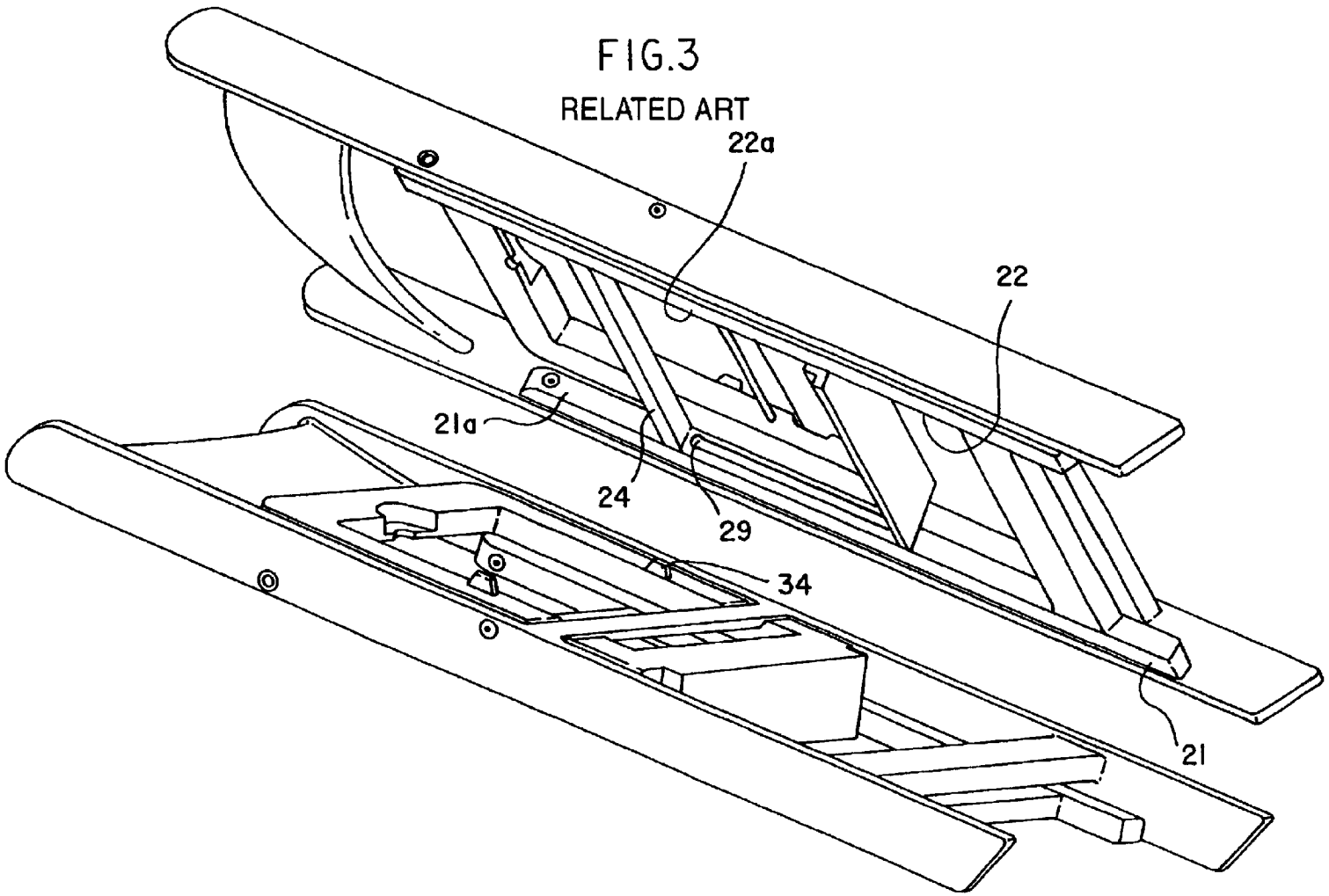
FIG.3 RELATED ART
FIG. 3 is a perspective view of two of the conventional stackable folding chairs shown in FIG. 1 before being stacked together.
Figure 4:
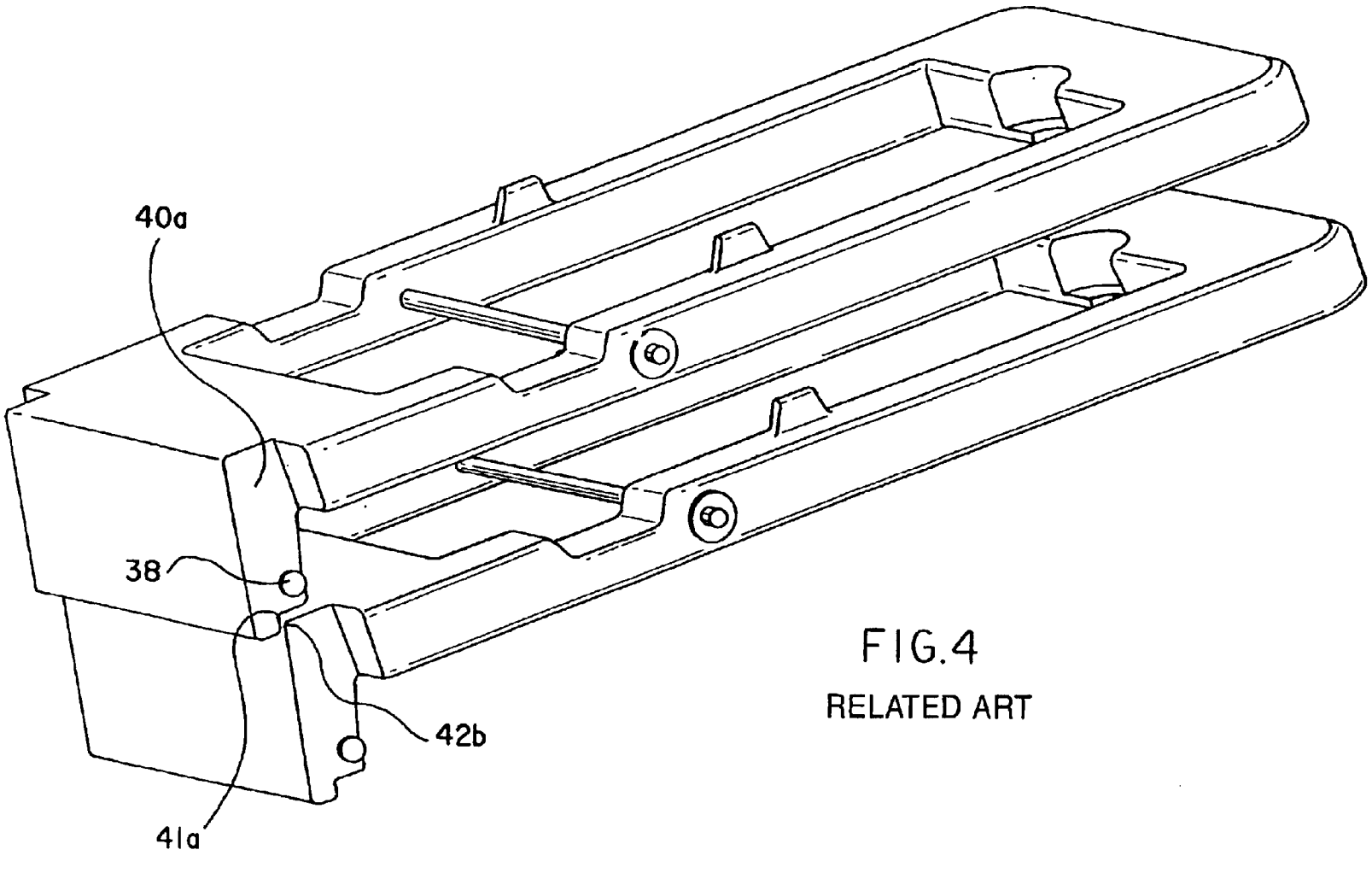
FIG. 4 RELATED ART
FIG. 4 is a perspective view of two seats from the conventional chairs stacked together.
Figure 9:
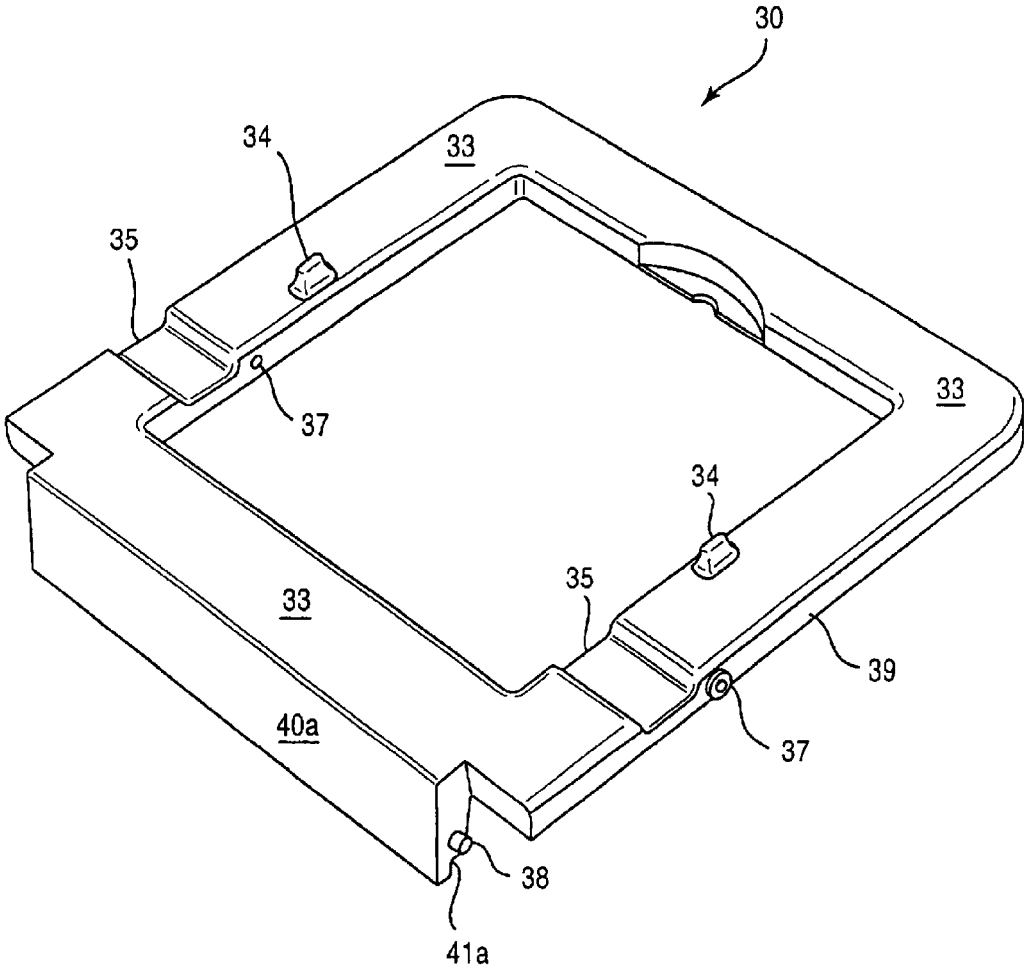
Fig.9 RELATED ART
FIG. 9 is a bottom view of the seat of the conventional chair shown in FIG. 1.

FIG. 9 is a bottom view of the seat 30 of the conventional chair, which includes has a substantially rectangular shape body and is pivotally connected to the front legs 11 and 12 by a rod 31 at a location above the intermediate crosspiece 14 and below the pivot pins 27, 27 connecting the support frame 20 to the main frame 10. As shown in FIGS. 2, 4 and 9, a bottom surface 33 of the seat 30 includes a pair of stacking guides 34 extending away therefrom and a receiving groove 35 that receives the intermediate crosspiece 14 of the main frame 10 when the chair 1 is folded. Furthermore, the rod 31 passes through the seat 30 via through-holes 37, 37 disposed intermediate the receiving groove 35 and stacking guide 34.

A stacking lip 40*a* is integrally formed with the seat 30 and extends away from an upper surface 39 of the seat in an orthogonal direction relative thereto to form a substantially right angle shape. The extending direction of the stacking lip 40*a* is substantially opposite relative to the extending direction of the stacking guides 34, i.e., upward and away from the upper surface 39 of the seat 30.

The stacking lip 40*a* includes a notch 41*a* extending substantially across an entire width W of the seat 30. The notch 41*a* that engages the top crosspiece 24 of the support frame 20 when the chair 1 is in the open or in use position. Furthermore, the stacking lip 40*a* has vertical height H relative to the upper surface 39 of the seat 30. The vertical height H of the stacking lip 40*a* is of a length wherein the notch 41*a* of the stacking lip 40*a* extends beyond an outer boundary defined by a rear face of either the front and back legs, 11,12 and 21,22, respectively, when the chair is in the folded position. As shown within the circle of FIG. 4, the notch 41*a* receives a lower rear corner 42*b* of a second seat when the first and second seats are in the closed or folded position (FIG. 5), thereby permitting the first and second chairs to be orderly stacked together.

Figure 5:
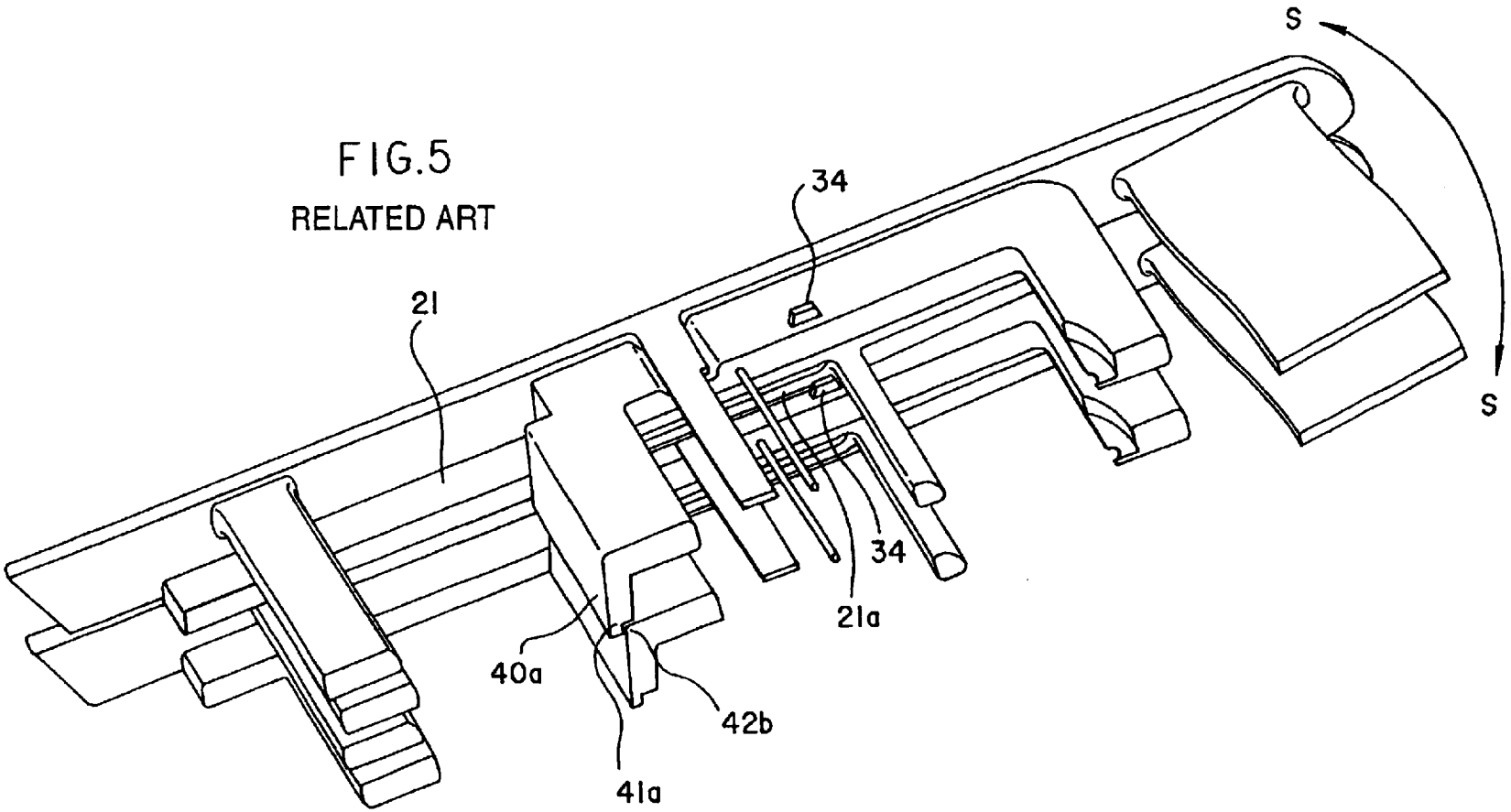
FIG.5 RELATED ART
FIG. 5 is a sectional view of two stacked conventional chairs.
Figure 6:
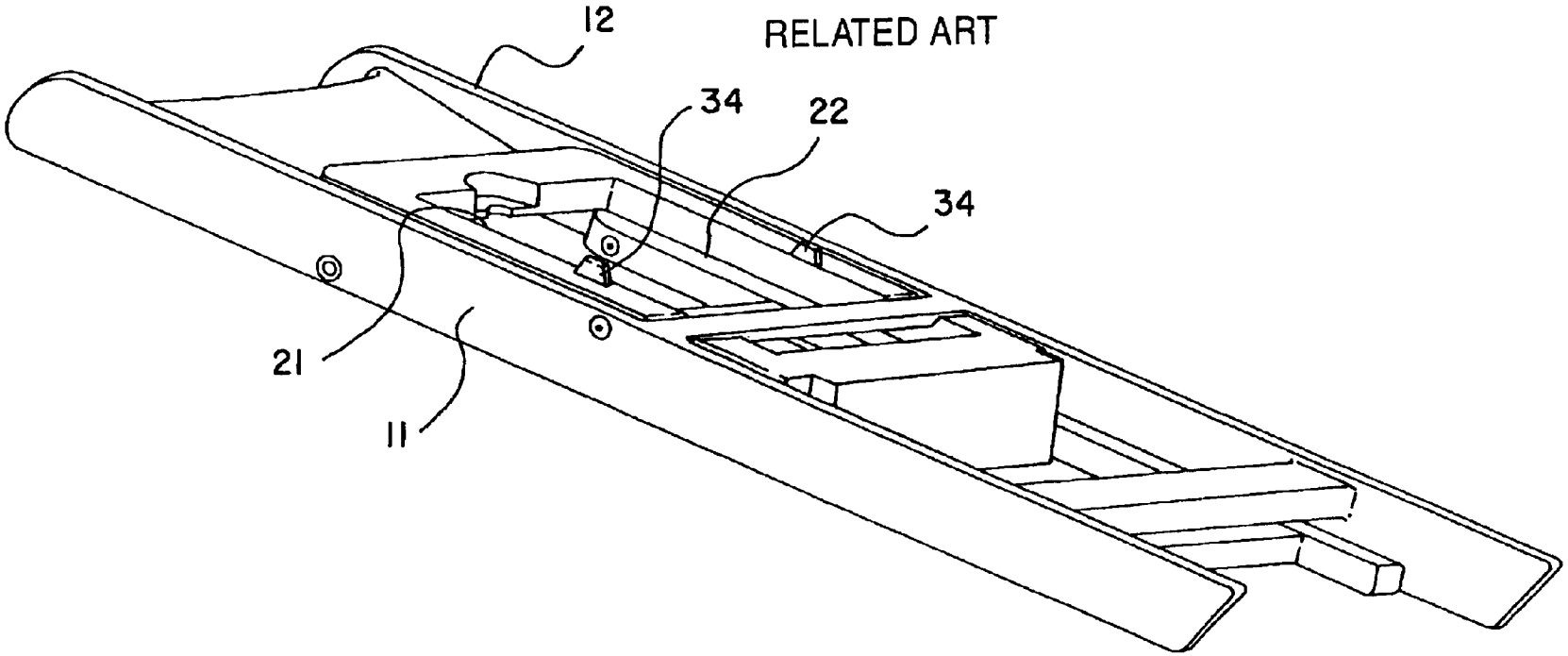
FIG.6 RELATED ART
FIG. 6 is a perspective view of a folded conventional chair

As shown in FIG. 5, when multiple chairs are folded to be stacked on top of each other, the stacking guides 34 of the first chair extend toward the second chair. The stacking guides 34 of each chair are designed to prevent the stacked chairs from sliding side to side as indicated by the line S—S when the chairs are stacked vertically, i.e., the support frame and seat of each chair are folded up or closed. Furthermore, the arrangement of the stacking guide 34 in conjunction with the notch 41*a* prevents the stacked chairs from sliding forward and backward relative to each other.

Figure 1:
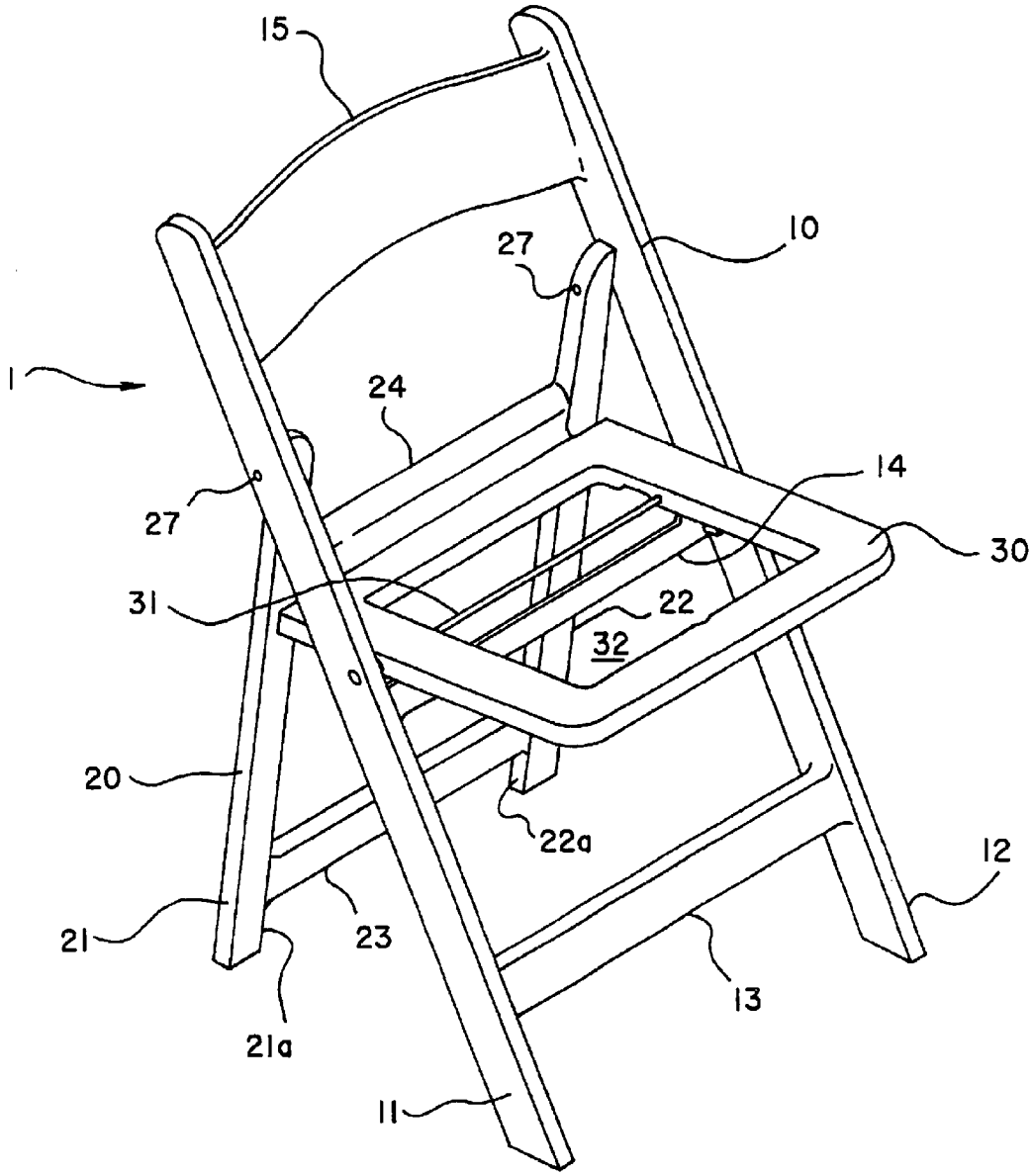
FIG.1 RELATED ART
FIG. 1 is a perspective view of a conventional stackable folding chair in the open or in use position.

The stacking guides 34 extending downward and away from the bottom surface 33 of the seat 30 engage the intermediate crosspiece 14 separating the front legs 11 and 12 of the main frame 10 (FIG. 1). Thus, when a downward force is applied to the seat 30, such as, for example, when a person sits down on the seat when the chair is in the open or in use position, the stacking guides 34 engage the intermediate crosspiece 14 and the notch 41*a* engages the top crosspiece 24.

Figure 10:
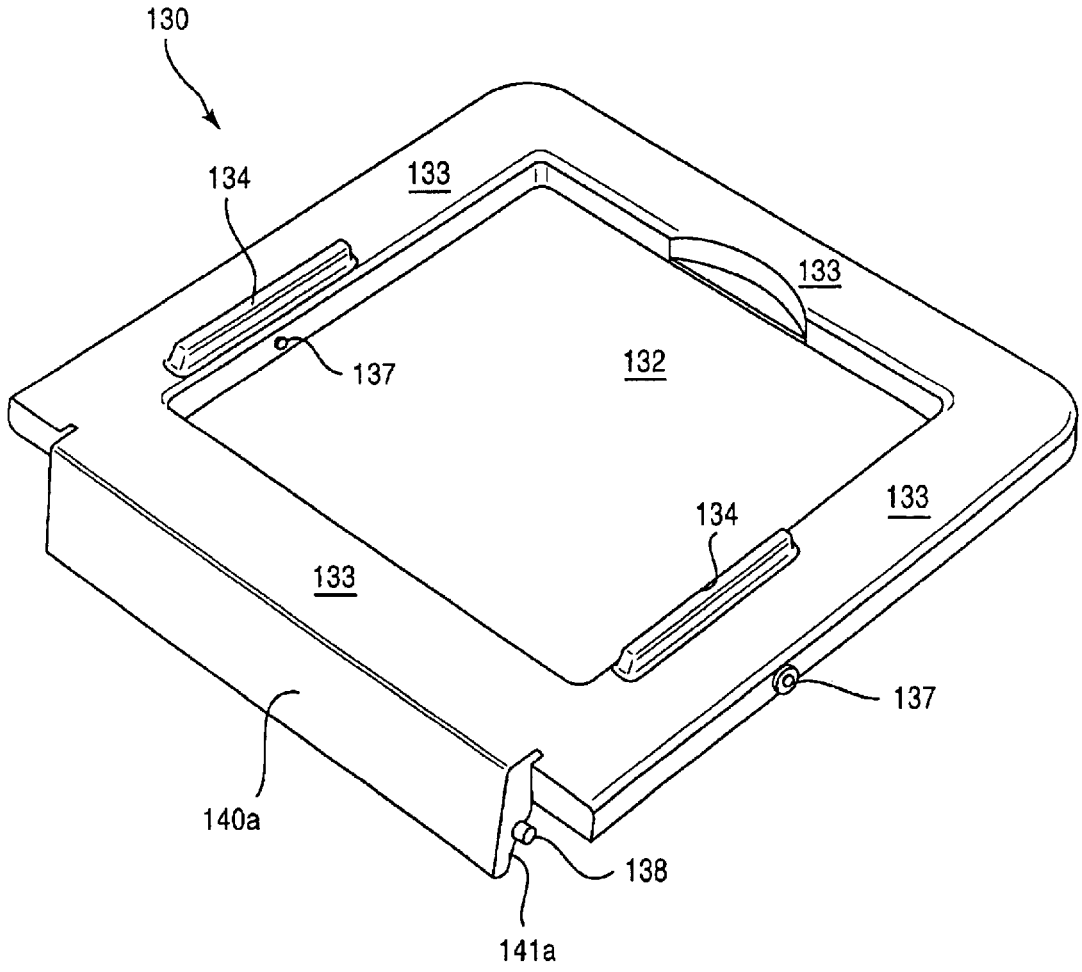
FIG. 10 is a bottom view of the seat of the stackable folding chair according to the present invention.

FIG. 10 is a bottom view of the seat 130 of the stackable folding chair according to the present invention. The seat 130 of the present invention has a substantially rectangular shape body and is pivotally connected to the front legs 111 and 112 by a rod 31 (FIG. 2) in a manner similar to the seat 30 in the conventional chair 1. Furthermore, the seat 130 of the present invention operates in a similar manner to the seat 30 of the conventional chair 1.

However, a comparison of the seat 30 from the conventional chair and the seat 130 from the stackable folding chair of the present invention reveals the fact that the seat 130 of the of the present invention does not include a receiving groove 35 (FIG. 9). The seat 130 of the present invention does not require a receiving groove because the seat of the present invention does not need to engage an intermediate crosspiece since the main frame 110 of the present invention does not provide such a feature. Moreover, the stacking guides 134 are extended in a lengthwise direction that is parallel relative to the surface 133 of the seat 130 so as to overlap or extend beyond the region of the seat 130 that includes the through-holes 137, 137, thereby increasing the overall strength of the seat 130.

As a result, the seat 130 of the present has a relatively uniform and smooth bottom surface 133 except for the stacking guides 134 extending along and away therefrom in a manner similar to the stacking guides 34 of the conventional chair. The uniform and smooth bottom 133 of the seat 130 of the present invention, see FIG. 10, allows the die from which the seat 130 is manufactured by resin or plastic injection molding to be simplified. As a result, the manufacturing labor and time, as well as overall costs, is substantially reduced. Furthermore, the possibility for imperfections to arise in the injection molded seat 130 of the present invention are greatly reduced. Additionally, the absence of a receiving groove in conjunction with extending the stacking guides 134 in a lengthwise direction that is parallel relative to the bottom surface 133 increases the overall strength of the seat 130. As will be explained below in further detail, the seat 130 of the present invention also has a pair of dowel pins 138 extending therefrom to connect the seat 130 of the present invention to the slots 29, 29 in the back legs 21, 22 of the support frame 20, as well as a stacking lip 140*a* with a notch 141*a* that function similar to the dowel pins 38, 38, notch 40*a*, and lip 41*a* of the conventional chair.

It should be noted that it is within the scope of this invention to have the rod 31 formed either from plastic or resin injection molding techniques, metal, wood or any other suitable material.

It should be noted that the seat 130 of the present invention is shown in the drawing figures as having an opening 132 defined therein merely for explanatory purposes as well as to better illustrate the spatial and working relationship of the features of the chair. It is within the scope of this invention to have a seat 130 with a solid body, i.e., no opening, or even a covering element (not shown) that covers or fills the opening 132.

More particularly and as shown in FIG. 10, the bottom surface 133 of the seat 130 of the present invention includes a pair of stacking guides 134 extending away therefrom. The stacking lip 140*a* is integrally formed with the seat 130 and extends away from an upper surface 139 of the seat in an orthogonal direction relative thereto to form a substantially right angle shape. The extending direction of the stacking lip 140*a* is substantially opposite relative to the extending direction of the stacking guides 134, i.e., upward and away from the upper surface 139 of the seat 130.

The stacking lip 140*a* on the seat 130 of the present invention includes a notch 141*a* extending substantially across an entire width W (see FIG. 2) of the seat 130. The notch 141*a* that engages the top crosspiece 24 of the support frame 20 when the chair is in the open or in use position. Furthermore, the stacking lip 140*a* has vertical height H (see FIG. 2) relative to the upper surface 139 of the seat 130. The vertical height H of the stacking lip 140*a* is of a length wherein the notch 141*a* of the stacking lip 140*a* extends beyond an outer boundary defined by a rear face of either the front and back legs, 111, 112 and 21, 22, respectively, when the chair is in the folded position.

As exemplarily shown within the circle of FIG. 4, the notch 141*a* of the seat 130 of the present invention can also receive a lower rear corner 42*b* of a second seat when the first and second seats are in the closed or folded position (FIG. 5), thereby permitting the first and second chairs to be orderly stacked together.

As exemplarily shown in FIG. 5, when multiple chairs are folded to be stacked on top of each other, the stacking guides 134 of the seat 130 of the present invention extend toward a second chair. As such, the stacking guides 134 of each chair are designed to prevent the stacked chairs from sliding side to side as indicated by the line S—S when the chairs are stacked vertically, i.e., the support frame and seat of each chair are folded up or closed. Furthermore, the arrangement of the stacking guides 134 in conjunction with the notch 141*a* prevents the stacked chairs from sliding forward and backward relative to each other.

When a downward force is applied to the seat 130 of the present invention, such as, for example, when a person sits down on the seat when the chair is in the open or in use position, the notch 141*a* engages the top crosspiece 24 of the support frame 20, which prevents the back legs 21 and 22 from separating away from the front legs 111 and 112.

The chair is used as follows.

Figure 12:
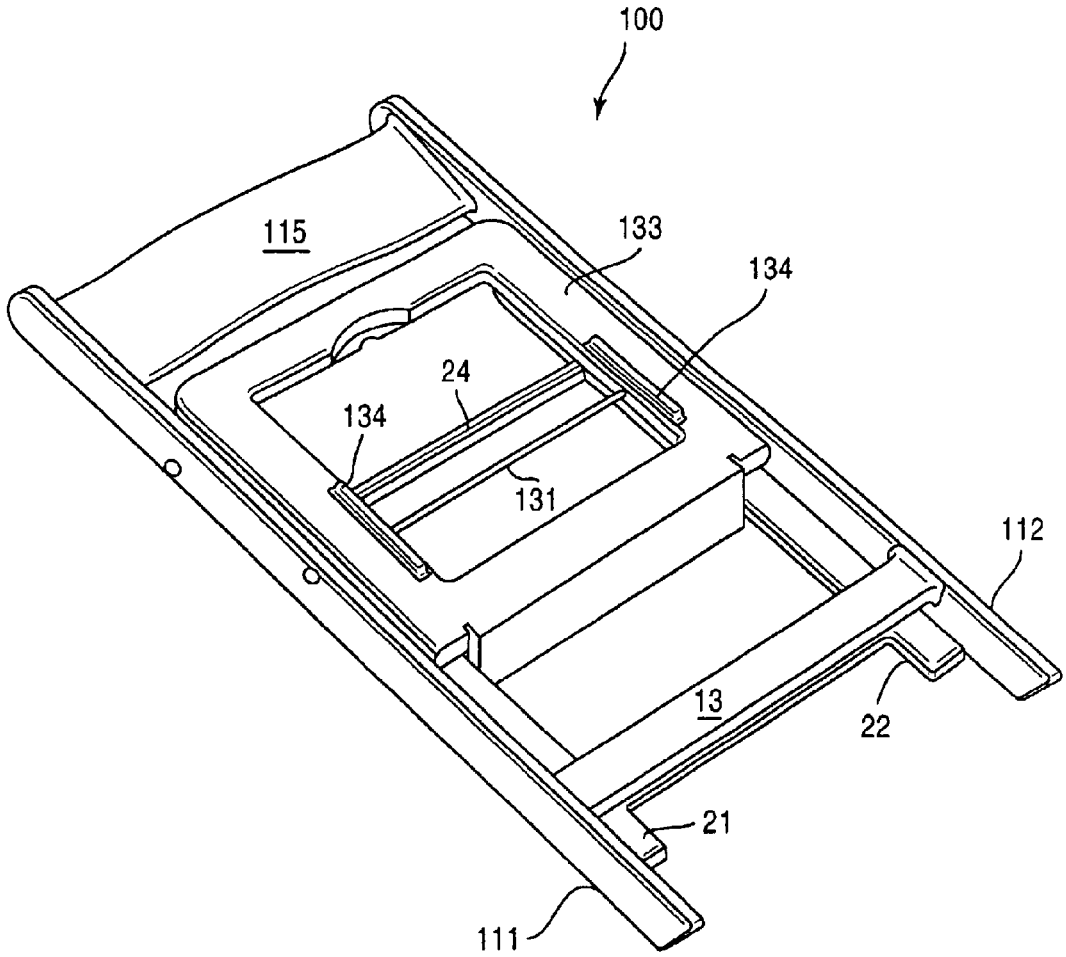
FIG. 12 is a perspective view of the stackable folding chair according to the present invention in the closed position.

When the chair is in the closed or folded position as shown in FIG. 12, the chair is ready to be stacked onto other such chairs. Furthermore, the support frame 20 of the chair rotates toward the main frame 110 wherein outer side surfaces of the back legs 21 and 22 of the support frame 20 abut inner side surface of the front legs 111 and 112 of the main frame 110. Additionally, a front portion of the seat 130 is proximate the backrest 115 of the main support 110 while the rear portion of the seat having the stacking lip 140*a* is located between the rod 31 of the seat 130 and the lower crosspiece 113 of the main support 110.

Figure 11:
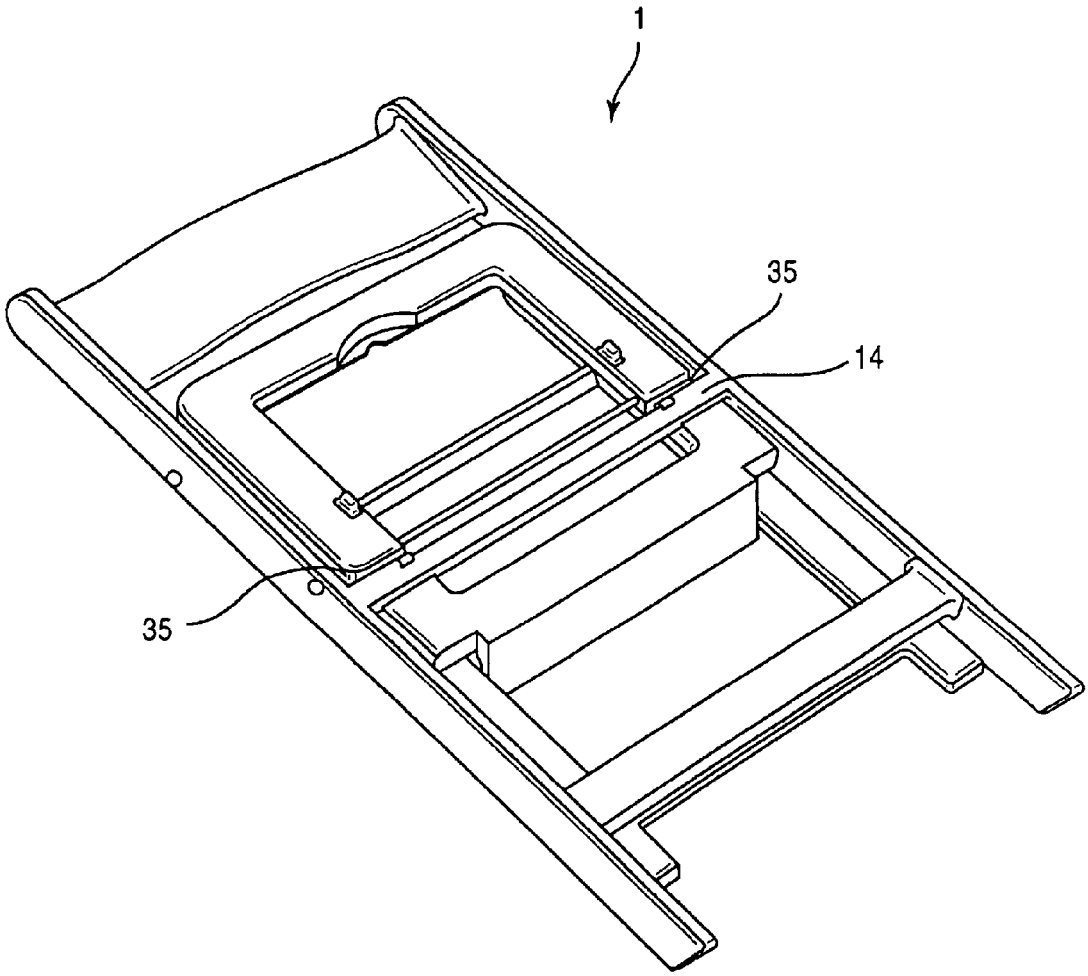
Fig.11 RELATED ART
FIG. 11 is a perspective view of the conventional folding chair in the closed position.

As shown in FIG. 11, the conventional chair 1 requires the receiving groove 35 to receive the intermediate crosspiece 14 of the conventional chair 1.

The chair of the present invention does not require such an action as the main support 110 does not include such an intermediate crosspiece and the seat 130 does not have such a receiving groove.

Figure 13:
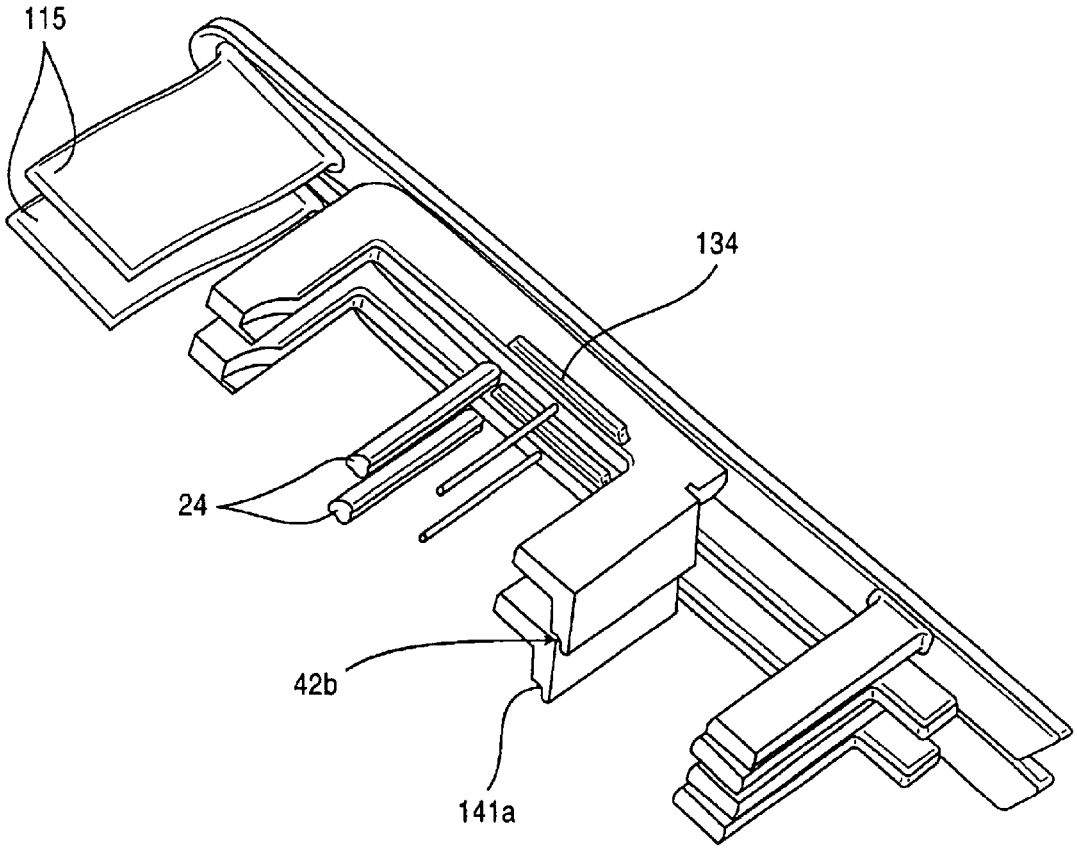
FIG. 13 is a sectional view of two stacked folding chairs according to the present invention.
Figure 14:
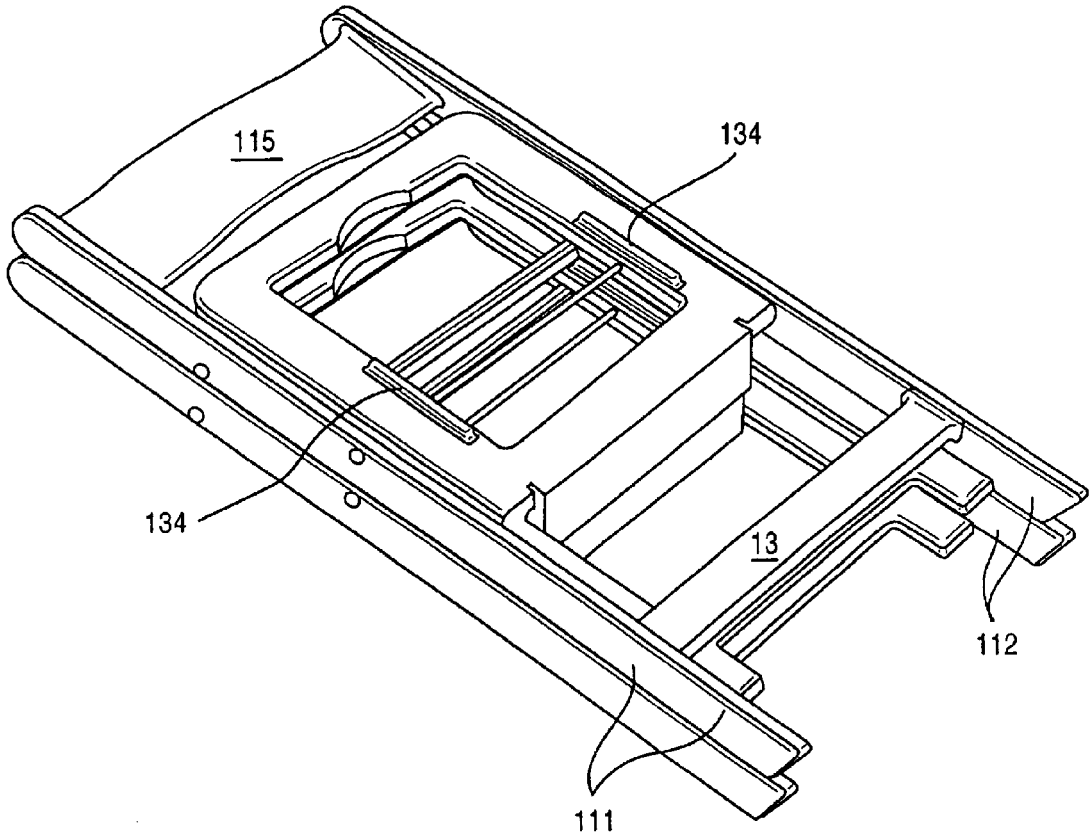
FIG. 14 is a perspective view of the complete stacked folding chairs shown in FIG. 13.

Therefore, when viewed from the side of the folded chair, the notch 141*a* of the stacking lip 140*a* extends beyond an outer boundary defined by a rear face of either the front and back legs, 111, 112 and 21, 22, respectively. As such, the notch 141*a* is able to receive a lower rear corner 42*b* of a second seat when the first and second seats are in the closed or folded position (FIGS. 13 and 14), thereby permitting the first and second chairs to be orderly stacked together. Furthermore, the stacking guides 134 of each chair prevent the stacked chairs from sliding side to side relative to each other.

Accordingly, an orderly and manageable stacking of multiple folding chairs is obtained.

Figure 15:
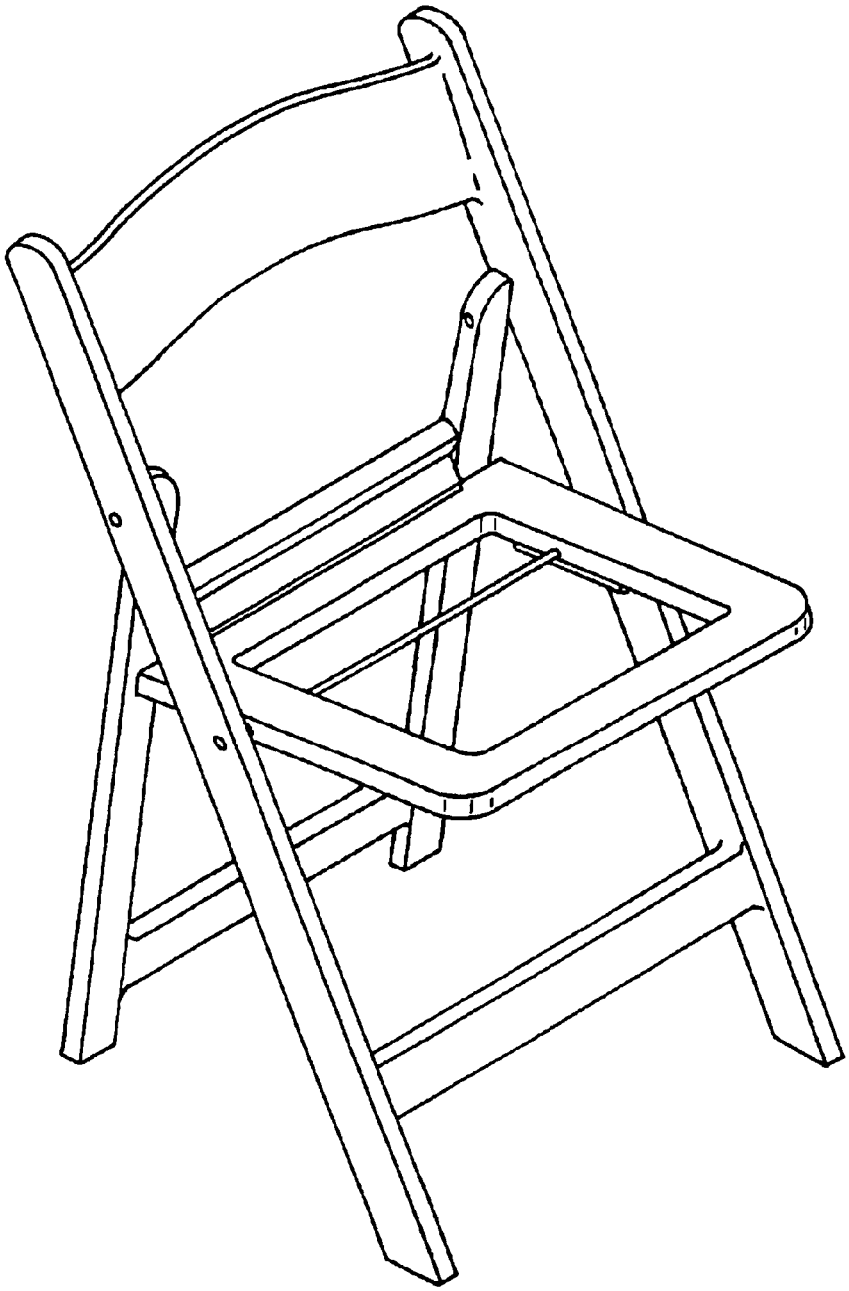
FIG. 15 is a perspective view of the stackable folding chair according to the present invention in the open or in use position.

To place the folded chair in the open or in use position (FIG. 15), the front portion of the seat 130 is rotated around rod 131 outwardly in a direction away from the abutting front and back legs 111, 112 and 21, 22, respectively. Simultaneously, the dowel pins 138 slide along the substantially linear dowel slots 29 formed in the rear legs 21, and 22 in an upward direction relative to the backrest 115. The sliding motion of the dowel pins 138 within the dowel slots 29 forces the rear legs 21, 22 of the support frame 20 to rotate around pins 27 and away from the front legs 111, 112 of the main frame 110. At the moment the dowel pins 138 reach the top of the dowel slots 29, the notch 141*a* of the stacking lip 140*a* engages the top crosspiece 24 of the support frame 20.

While the invention has been described in conjunction with the preferred embodiment thereof, it is evident that many alternatives, modifications and variations may be apparent to those skilled in the art. For example, the stacking guides may be configured to have any suitable geometric configuration, such as, for example, circular, rectangular, trapezoidal, triangular, rhomboidal, oval, square, pentagonal, octagonal, parabolic, hyperbolic, elliptical, conical, and the like. Accordingly, the specific embodiment of the invention as set forth herein is intended merely to be illustrative, not limiting. Various changes may be made without departing from the spirit and scope of the invention as set forth in the following claims.

What is claimed is:

1. A seat usable with a stackable folding chair having a main frame including a pair of substantially parallel front legs separated by lower and upper crosspieces, the top crosspiece forming a backrest, each of the front legs having an inner side face and a rear face, a support frame including a pair of substantially parallel back legs separated by upper and lower crosspieces, each of the back legs having inner and outer side faces along with a rear face and being pivotally connected to the front legs by pivot pins, the inner side faces of each of the back legs having a dowel slot, the seat comprising:

a body, wherein the body has an upper surface and a lower surface;

a rod pivotally connecting the seat to the main frame via a pair of through-holes formed in the seat; and a stacking lip that extends away from the upper surface of the seat body in an orthogonal direction relative thereto to form a substantially right angle shape, the stacking lip including a notch extending substantially across an entire width of the seat body, the stacking lip having a vertical height wherein the notch extends beyond an outer boundary defined by the rear face of either one of the front and back legs when the chair is in a folded position, wherein the lower surface has a uniform and smooth surface area throughout.

2. The seat according to claim 1, further comprising a pair of dowel pins that slidingly engage the dowel slots of the inner side faces of the back legs.

3. The seat according to claim 1, wherein the notch is configured to receive a lower back portion of a seat of another folding chair and wherein the notch permits stacking of a plurality of chairs.

4. The seat according to claim 1, wherein the notch engages the upper crosspiece of the support frame when the chair is in an open position.

5. The seat according to claim 1, wherein the seat body further comprises:

a lower surface opposite the upper surface; and a pair of stacking guides extending away from the lower surface of the seat, wherein the stacking guides engage the inner side faces of the back legs when the chair is in the folded position to prevent the chair from sliding off another chair upon which the chair is stacked.

6. The seat according to claim 1, wherein the seat is formed of an injection molded plastic.

7. A stackable folding chair, comprising:

a main frame including a pair of substantially parallel front legs separated by lower and upper crosspieces, wherein the top crosspiece forms a backrest, each of the front legs having an inner side face and a rear face;

a support frame including a pair of substantially parallel back legs separated by upper and lower crosspieces, wherein each back leg has inner and outer side faces along with a rear face and is pivotally connected to the front legs by pivot pins, the inner side faces of each of the back legs having a dowel slot; and a seat connected to the main frame, the seat comprising:

a rod pivotally connecting the seat to the main frame via a pair of through-holes formed in the seat;

an upper surface;

a lower surface; and a stacking lip that extends away from the upper surface of the seat in an orthogonal direction relative thereto to form a substantially right angle shape, the stacking lip including a notch extending substantially across an entire width of the seat, the stacking lip having a vertical height wherein the notch extends beyond an outer boundary defined by of the rear face of either the front and back legs when the chair is in a folded position, wherein the lower surface has a uniform and smooth surface area throughout.

8. The folding chair according to claim 7, wherein the seat further comprises a pair of dowel pins that slidingly engage the dowel slots of the inner side faces of the back legs.

9. The folding chair according to claim 7, wherein the notch is configured to receive a lower back portion of a seat of another folding chair and wherein the notch permits stacking of a plurality of chairs.

10. The folding chair according to claim 7, wherein the notch engages the upper crosspiece of the support frame when the chair is in an open position.

11. The folding chair according to claim 7, wherein the seat further comprises a pair of stacking guides extending away from the lower surface of the seat, wherein the stacking guides engage the inner side faces of the back legs when the chair is in the folded position to prevent the chair from sliding off another chair upon which the chair is stacked, and wherein an arrangement of the stacking guides in conjunction with the notch of the stacking lip prevents the chair in the folded position from sliding forward and backward relative to the other chair upon which the chair is stacked.

12. The folding chair according to claim 11, wherein each stacking guide extends in a lengthwise direction parallel relative to the lower surface of the seat to at least overlap a region of the seat including a corresponding through-hole of the pair of through-holes.

13. The folding chair according to claim 7, wherein the chair is formed of an injection molded plastic.

14. The seat according to claim 6, wherein each stacking guide extends in a lengthwise direction parallel relative to the lower surface of the seat to at least overlap a region of the seat including a corresponding through-hole of the pair of through-holes.

* * * * *